US011830406B2

(12) United States Patent
Koh et al.

(10) Patent No.: US 11,830,406 B2
(45) Date of Patent: Nov. 28, 2023

(54) DISPLAY DEVICE

(71) Applicant: Samsung Display Co., LTD., Yongin-si (KR)

(72) Inventors: Jae Hyun Koh, Yongin-si (KR); Jin Pil Kim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/868,145

(22) Filed: Jul. 19, 2022

(65) Prior Publication Data

US 2023/0137600 A1 May 4, 2023

(30) Foreign Application Priority Data

Nov. 4, 2021 (KR) ..... 10-2021-0150750

(51) Int. Cl.
*G09G 3/3266* (2016.01)
*G09G 3/3233* (2016.01)
*G09G 3/20* (2006.01)

(52) U.S. Cl.
CPC ..... *G09G 3/2007* (2013.01); *G09G 3/3266* (2013.01); *G09G 3/3233* (2013.01); *G09G 2300/0426* (2013.01); *G09G 2300/0819* (2013.01); *G09G 2300/0842* (2013.01); *G09G 2310/08* (2013.01); *G09G 2320/0233* (2013.01)

(58) Field of Classification Search
None
See application file for complete search history.

(56) References Cited

U.S. PATENT DOCUMENTS 9,378,706 B2 6/2016 Cha
2002/0195957 A1* 12/2002 Higuchi ..... G09G 3/296 315/169.2
2003/0067430 A1 4/2003 Kim
2010/0085341 A1* 4/2010 Hasegawa ..... G09G 3/3258 345/208
2019/0156761 A1 5/2019 Kim et al.
(Continued)

FOREIGN PATENT DOCUMENTS

CN 109979392 7/2019
JP 2011-209523 10/2011
(Continued)

*Primary Examiner* — Nitin Patel
*Assistant Examiner* — Amen W Bogale
(74) *Attorney, Agent, or Firm* — KILE PARK REED & HOUTTEMAN PLLC

(57) ABSTRACT

A display device includes a display panel including areas including pixels electrically connected to a plurality of gate lines and a plurality of data lines; a gate driver that supplies a gate signal to each of the plurality of gate lines; an average grayscale calculator that receives input image data, and calculating average grayscale values with respect to the areas; an area determiner that compares the average grayscale values with a low grayscale reference value to determine a low grayscale area among the areas, and output a charge boosting signal; a memory that stores gate clock signal information according to a grayscale; and a gate clock signal generator that supplies a gate clock signal corresponding to the areas to the gate driver by reflecting the charge boosting signal and the gate clock signal information according to the grayscale.

20 Claims, 11 Drawing Sheets

(56) References Cited

U.S. PATENT DOCUMENTS

| | | | | |
|---|---|---|---|---|
| 2020/0202766 | A1* | 6/2020 | Lee | G09G 1/167 |
| 2020/0320922 | A1* | 10/2020 | Ko | G09G 3/3266 |

FOREIGN PATENT DOCUMENTS

| | | |
|---|---|---|
| KR | 10-0396899 | 9/2003 |
| KR | 10-1954797 | 3/2019 |
| KR | 10-2019-0057191 | 5/2019 |
| KR | 10-2100915 | 4/2020 |
| KR | 10-2020-0088696 | 7/2020 |

* cited by examiner

DISPLAY DEVICE

CROSS-REFERENCE TO RELATED APPLICATION(S)

This application claims priority to and benefits of Korean Patent Application No. 10-2021-0150750 under 35 U.S.C. § 119, filed in the Korean Intellectual Property Office on Nov. 4, 2021, the entire contents of which are incorporated herein by reference.

BACKGROUND

1. Technical Field

The disclosure generally relates to a display device capable of improving luminance characteristics in a low grayscale area.

2. Description of the Related Art

The display devices have grown in popularity and commercialization because of the interest in information displays and the demand for portable information media.

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

Embodiments provide a display device capable of improving luminance characteristics in a low grayscale area.

However, embodiments of the disclosure are not limited to those set forth herein. The above and other embodiments will become more apparent to one of ordinary skill in the art to which the disclosure pertains by referencing the detailed description of the disclosure given below.

In accordance with an aspect of the disclosure, there is provided a display device including a display panel including areas including pixels electrically connected to a plurality of gate lines and a plurality of data lines; a gate driver that supplies a gate signal to each of the plurality of gate lines; an average grayscale calculator that receives input image data, and calculate average grayscale values with respect to the areas; an area determiner that compares the average grayscale values with a low grayscale reference value to determine a low grayscale area among the areas, and output a charge boosting signal; a memory that stores gate clock signal information according to a grayscale; and a gate clock signal generator that supplies a gate clock signal corresponding to the areas to the gate driver by reflecting the charge boosting signal and the gate clock signal information according to the grayscale.

The gate clock signal generator may supply a first gate clock signal to the gate driver, with respect to the low grayscale area among the areas, based on first gate clock signal information corresponding to the low grayscale area in the gate clock signal information according to the grayscale.

The gate clock signal generator may supply a second gate clock signal to the gate driver, with respect to a normal grayscale area among the areas, based on second gate clock signal information corresponding to the normal grayscale area in the gate clock signal information according to the grayscale.

The gate clock signal generator may interpolate the first gate clock signal and the second gate clock signal to generate the third gate clock signal, and supply the third gate clock signal to the gate driver in an interpolation area between the normal grayscale area adjacent to the low grayscale area and the low grayscale area among the areas.

The areas may be adjacent to each other in a first direction. A data signal may be supplied to each of the plurality of data lines disposed in each of the areas. The data signal may be generated based on the input image data.

The area determiner may determine, as the low grayscale area, an area having a value smaller than the low grayscale reference value among the average grayscale values.

The memory may further store a minimum grayscale reference value and a maximum grayscale reference value with respect to each of the areas.

The area determiner may compare a minimum grayscale value with respect to each of the areas with the minimum grayscale reference value and compare a maximum grayscale value with respect to each of the areas with the maximum grayscale reference value to determine the low grayscale area among the areas.

The charge boosting signal may include grayscale information on the areas.

In accordance with another aspect of the disclosure, there is provided a display device including a display panel including areas including pixels electrically connected to a plurality of gate lines and a plurality of data lines; a gate driver that supplies a gate signal to each of the plurality of gate lines; and a timing controller that receives input image data and a data enable signal, and supplies a gate clock signal corresponding to the gate signal to the gate driver, wherein the timing controller calculates average grayscale values with respect to the areas, compares the average grayscale values with a low grayscale reference value to determine a low grayscale area and a normal grayscale area among the areas, and supplies a gate clock signal corresponding to each of the areas to the gate driver, based on the data enable signal with respect to the area.

The data enable signal may include a reference data enable signal and a modified data enable signal. The timing controller may supply a first gate clock signal corresponding to the low grayscale area to the gate driver, based on the modified data enable signal.

The timing controller may supply a second gate clock signal corresponding to the normal grayscale area to the gate driver, based on the reference data enable signal.

The timing controller may interpolate the first gate clock signal and the second gate clock signal to generate a third gate clock signal, and supply the third gate clock signal to the gate driver in an interpolation area between the normal grayscale area adjacent to the low grayscale area and the low grayscale area among the areas.

The areas may be adjacent to each other in a first direction. A data signal may be supplied to each of the plurality of data lines disposed in each of the areas. The data signal may be generated based on the input image data.

The timing controller may determine, as the low grayscale area, an area having a value smaller than the low grayscale reference value among the average grayscale values.

The display device may further include a memory that stores a minimum grayscale reference value and a maximum grayscale reference value with respect to each of the areas. The timing controller may compare a minimum grayscale value with respect to each of the areas with the minimum grayscale reference value and compare a maximum grayscale value with respect to each of the areas with the maximum grayscale reference value to determine the low grayscale area among the areas.

In accordance with still another aspect of the disclosure, there is provided a display device including a display panel including areas including pixels electrically connected to a plurality of gate lines and a plurality of data lines; a gate driver that supplies a gate signal to each of the plurality of gate lines; a timing controller that supplies a gate clock signal corresponding to the gate signal to the gate driver; and a memory that stores gate clock signal information according to a grayscale, wherein the timing controller calculates average grayscale values with respect to the areas, compares the average grayscale values with a low grayscale reference value to determine a low grayscale area and a normal grayscale area among the areas, and supplies a gate clock signal corresponding to each of the areas to the gate driver by reflecting the gate clock signal information according to the grayscale.

The timing controller may supply a first gate clock signal to the gate driver, based on first gate clock signal information corresponding to the low grayscale area in the gate clock signal information according to the grayscale.

The timing controller may supply a second gate clock signal to the gate driver, based on second gate clock signal information corresponding to the normal grayscale area in the gate clock signal information according to the grayscale.

The timing controller may interpolate the first gate clock signal and the second gate clock signal to generate a third gate clock signal, and supply the third gate clock signal to the gate driver in an interpolation area between the normal grayscale area adjacent to the low grayscale area and the low grayscale area.

BRIEF DESCRIPTION OF THE DRAWINGS

An additional appreciation according to the embodiments of the disclosure will become more apparent by describing in detail the embodiments thereof with reference to the accompanying drawings, wherein.

DETAILED DESCRIPTION OF THE EMBODIMENTS

Figure 1:
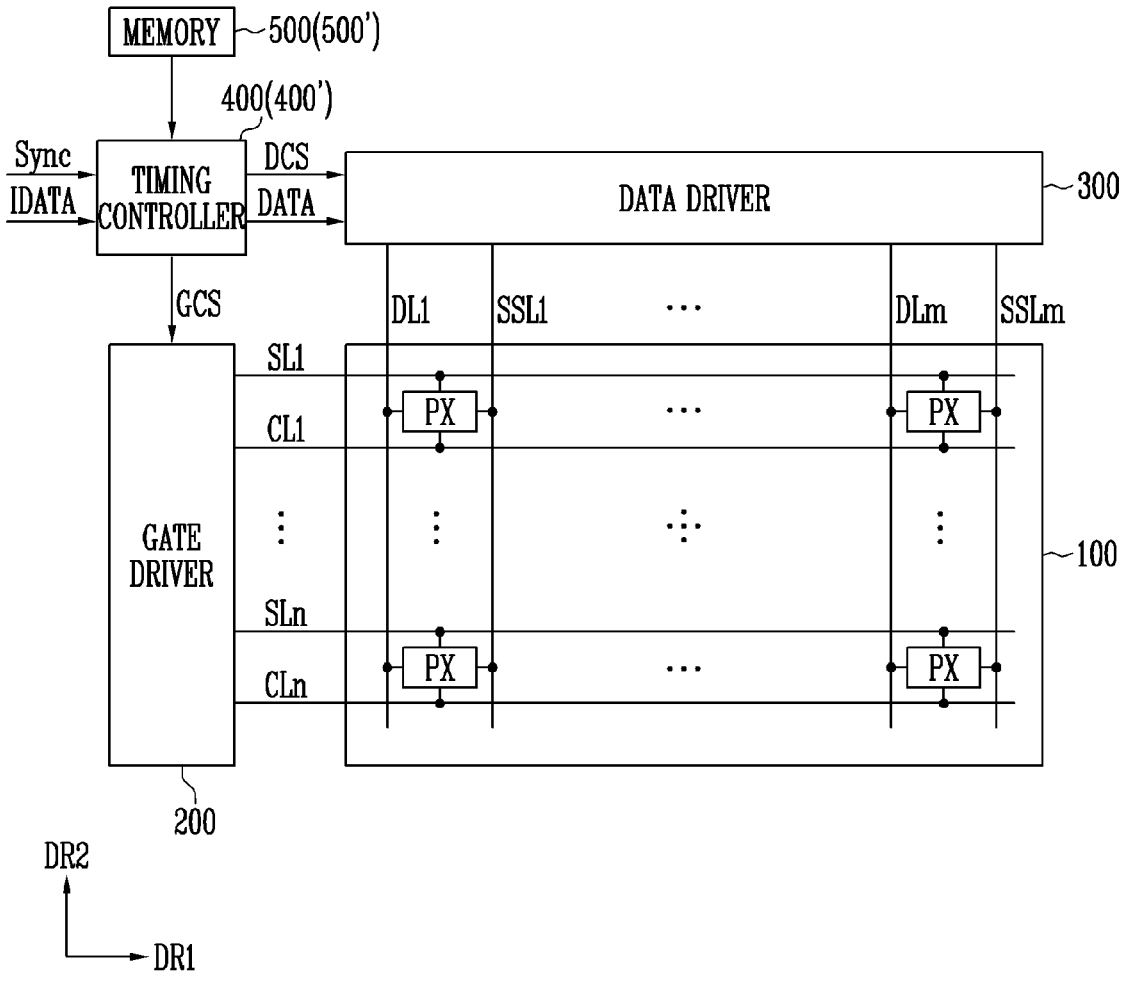
FIG. 1 is a schematic block diagram illustrating a display device in accordance with an embodiment of the disclosure.

In the following description, for the purpose of explanation, numerous specific details are set forth in order to provide a thorough understanding of various embodiments or implementations of the disclosure. As used herein "embodiments" and "implementation" are interchangeable words that are non-limiting examples of devices or methods disclosed herein. It is apparent, however, that various embodiments may be practiced without these specific details or with one or more equivalent arrangements. Here, various embodiments do not have to be exclusive not limit the disclosure. For example, specific shapes, configurations, and characteristics of an embodiment may be used or implemented in another embodiment.

Unless otherwise specified, the illustrated embodiments are to be understood as providing features of the disclosure. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

Although the terms "first", "second", and the like may be used herein to describe various types of elements, these elements should not be limited by these terms. These terms are used to distinguish one element from another element. Thus, a "first" element discussed below could be termed a "second" element without departing from the teachings of the disclosure. As used herein, the singular forms are intended to include the plural forms as well, unless the context clearly indicates otherwise.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" may encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided various that would be recognized by one of ordinary skill in the art.

Various embodiments are described herein with reference to sectional and/or exploded illustrations that are schematic illustrations of embodiments and/or intermediate structures. As such, variations from the shapes of the illustrations as a result, for example, of manufacturing techniques and/or tolerances, are to be expected. Thus, embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements.

The terms "about" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

The phrase "at least one of" is intended to include the meaning of "at least one selected from the group of" for the purpose of its meaning and interpretation. For example, "at least one of A and B" may be understood to mean "A, B, or A and B."

Unless otherwise defined or implied herein, all terms (including technical and scientific terms) used herein have the same meaning as commonly understood by those skilled in the art to which this disclosure pertains. It will be further understood that terms, such as those defined in commonly used dictionaries, should be interpreted as having a meaning that is consistent with their meaning in the context of the relevant art and the disclosure, and should not be interpreted in an ideal or excessively formal sense unless clearly so defined herein.

Figure 2:
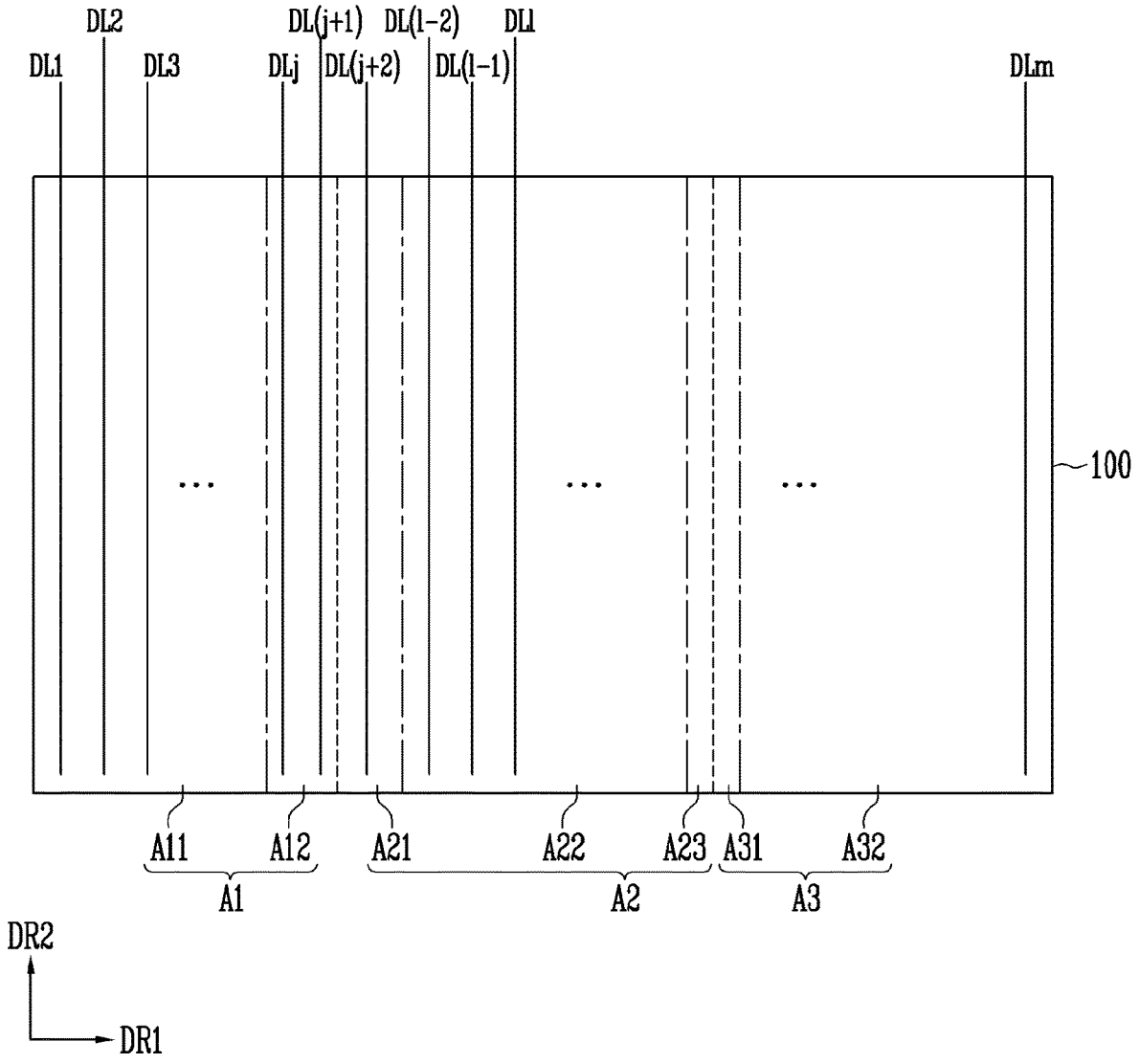
FIG. 2 is a schematic diagram illustrating a display panel shown in FIG. 1.

FIG. 1 is a schematic block diagram illustrating a display device in accordance with an embodiment of the disclosure. FIG. 2 is a schematic diagram illustrating a display panel shown in FIG. 1.

Referring to FIG. 1, the display device may include a display panel 100, a gate driver 200, a data driver 300, a timing controller 400 (or 400'), and a memory 500 (or 500').

The display device may be an organic light emitting display device or an inorganic light emitting display device. For example, the display device may include a flexible display device, a rollable display device, a curved display device, a transparent display device, a mirror display device, or the like, which are implemented as an organic light emitting display device, or the like.

The display panel 100 may include pixels PX for displaying an image, gate lines SL1 to SLn, control lines CL1 to CLn, data lines DL1 to DLm, and sensing lines SSL1 to SSLm. For example, the display panel 100 may include at least one pixel PX (or each pixel PX) electrically connected to at least one of the gate lines SL1 to SLn, at least one of the control lines CL1 to CLn, at least one of the data lines DL1 to DLm, and at least one of the sensing lines SSL1 to SSLm.

Each of the gate lines SL1 to SLn and the control lines CL1 to CLn may extend in a first direction DR1. Each of the data lines DL1 to DLm and the sensing lines SSL1 to SSLm may extend in a second direction DR2.

Referring to FIG. 2, the display panel 100 of the display device in accordance with the embodiment of the disclosure may include at least one area. For example, the display panel 100 may include multiple areas.

In an example, the display panel 100 may include a first area A1, a second area A2, and a third area A3, which are adjacent to each other in the first direction DR1. For example, each of the first to third areas A1, A2, and A3 may extend in the second direction DR2. The first area A1 may include a (1-1)th sub-area A11 and a (1-2)th sub-area A12. The second area A2 may include a (2-1)th sub-area A21, a (2-2)th sub-area A22, and a (2-3)th sub-area A23. The third area A3 may include a (3-1)th sub-area A31 and a (3-2)th sub-area A32. The (1-2)th sub-area A12 and the (2-1)th sub-area A21 may be adjacent to each other in the first direction DR1. The (2-3)th sub-area A23 and the (3-1)th sub-area A31 may also be adjacent to each other in the first direction DR1. The three areas A1, A2, and A3 shown in FIG. 2 are merely illustrative. In an embodiment, areas and sub-areas, which are adjacent to each other in the first direction DR1 according to a reference, may be variously changed.

A first data line DL1, a second data line DL2, and a third data line DL3 among the data lines DL1 to DLm may be disposed in the (1-1)th sub-area A11. A jth data line DLj, a (j+1)th data line DL(j+1), and a (j+2)th data line DL(j+2) among the data lines DL1 to DLm may be disposed in the (1-2)th sub-area A12 and the (2-1)th sub-area A21. An (l−2)th data line DL(l−2), an (l−1)th data line DL(l−1), and an lth data line DLl among the data lines DL1 to DLm may be disposed in the (2-2)th sub-area A22. In FIG. 2, it is illustrated that only three data lines are disposed in each sub-area. However, in some embodiments, the number of data lines disposed in each sub-area and each area may be variously changed.

The areas of the display panel 100 may be divided into a low grayscale area and a normal grayscale area by the timing controller 400 which is described below. The low-grayscale image may be displayed in the low grayscale area. Middle grayscale and high grayscale images may be displayed in the normal grayscale area instead of the low grayscale image. An area between the low grayscale area and the normal grayscale area adjacent to the low grayscale area may correspond to an interpolation area.

The gate driver 200 may provide a gate signal and a control signal to each of the pixels PX through the gate lines SL1 to SLn and the control lines CL1 to CLn. The gate driver 200 may provide the gate signal and the control signal to each of the pixels PX, based on a gate control signal GCS received from the timing controller 400 which is described below. In an embodiment, the gate control signal GCS may include a gate clock signal and a scan start pulse, but the disclosure is not limited thereto. The gate driver 200 may control a first timing of the gate signal by the scan start pulse, and allow the scan start pulse to be shifted by the gate clock signal.

The gate driver 200 may sequentially supply gate signals (or multiple gate signals) to the gate lines SL1 to SLn. In case that the gate signals are sequentially supplied, the pixels PX may be selected for each horizontal line (or parts of pixel rows). For example, the gate signal may be set to a turn-on level (e.g., a logic high voltage). A transistor receiving the gate signal among transistors of the pixel PX may be turned on in case that the gate signal is supplied.

In FIG. 1, it is illustrated that the gate lines SL1 to SLn and the control lines CL1 to CLn are electrically connected to a gate driver 200. However, in some embodiments, each of the gate lines SL1 to SLn and the control lines CL1 to CLn may be electrically connected to separate gate drivers.

The data driver 300 may supply a data signal (or data voltage) to the pixels PX through the data lines DL1 to DLm. The data driver 300 may supply the data signal to the pixels PX, based on a data control signal DCS and image data DATA, which are received from the timing controller 400 which is described below.

The data driver 300 may supply data signals to the data lines DL1 to DLm to be synchronized with the gate signal. The data signal may be supplied to a pixel PX (or a transistor of the pixel PX) selected by the gate signal.

The data driver 300 may supply, to the display panel 100, a data signal (e.g., a sensing data signal) for detecting a characteristic of the pixel PX in a sensing period. For example, the data driver 300 may receive a sensing current or a sensing voltage of the pixel PX, which is extracted (or sensed) through the sensing lines SSL1 to SSLm during the sensing period. The sensing current or the sensing voltage, which is extracted (or sensed) from the pixel PX, may include characteristic information of a driving transistor, information of a light emitting element, or the like. The data driver 300 may supply a compensation data signal (e.g., a compensation image data signal) to the display panel 100 based on the image data DATA in a display period. The compensation data signal (e.g., compensation image data signal) may be compensated by reflecting (or based on) the sensing current or the sensing voltage of the pixel PX.

In FIG. 1, the data driver 300 may be electrically connected to the data lines DL1 to DLm and the sensing lines SSL1 to SSLm to supply a data signal and receive a sensing current or a sensing voltage. However, the disclosure is not limited thereto. In some embodiments, the data driver 300 may be electrically connected to only the data lines DL1 to DLm, and the sensing lines SSL1 to SSLm may be electrically connected to a separate sensing part (not illustrated) to sense a characteristic (e.g., electrical characteristics) of the pixel PX. The separate sensing part (not illustrated) may compensate for image data and provide the compensated image data to the data driver 300.

The timing controller 400 (or 400') may generate the gate control signal GCS and the data control signal DCS, corresponding to a synchronization signal Sync supplied from the outside. The gate control signal GCS may be supplied to the gate driver 200, and the data control signal DCS may be supplied to the data driver 300.

The synchronization signal Sync may include a vertical synchronization signal, a horizontal synchronization signal, a data enable signal, a dot clock signal, or the like. For example, the timing controller 400 (or 400') may generate the gate control signal GCS and the data control signal DCS, based on the vertical synchronization signal, the horizontal synchronization signal, the data enable signal, the dot clock signal, or the like.

For example, the timing controller 400 (or 400') may realign input image data supplied from the outside as image data DATA and supply the image data DATA to the data driver 300.

In an embodiment, the timing controller 400 may calculate average grayscale values with respect to the areas A1, A2, and A3 of the display panel 100. The timing controller 400 may compare the average grayscale values with a low grayscale reference value to determine a low grayscale area and a normal grayscale area among the areas A1, A2, and A3. The timing controller 400 may supply a gate clock signal corresponding to each of the areas A1, A2, and A3 of the display panel 100 by reflecting (or based on) gate clock signal information according to a grayscale.

The timing controller 400 may supply a first gate clock signal to the gate driver 200, based on first gate clock signal information corresponding to the low grayscale area in the gate clock signal information according to the grayscale. For example, the timing controller 400 may supply a second gate clock signal to the gate driver 200, based on second gate clock signal information corresponding to the normal grayscale area in the gate clock signal information according to the grayscale. The timing controller 400 may interpolate the first gate clock signal and the second gate clock signal to generate a third gate clock signal, and supply the third gate clock signal to the gate driver 200 in the interpolation area between the normal grayscale area adjacent to the low grayscale area and the low grayscale area.

In an embodiment, the timing controller 400' may calculate average grayscale values with respect to the areas A1, A2, and A3 of the display panel 100. The timing controller 400' may compare the average grayscale values with a low grayscale reference value to determine a low grayscale area and a normal grayscale area among the areas A1, A2, and A3. The timing controller 400' may supply a gate clock signal corresponding to each area of the areas A1, A2, and A3 to the gate driver 200, based on a data enable signal with respect to the each of the areas A1, A2, and A3. The data enable signal may include a reference data enable signal and a changed data enable signal.

The timing controller 400' may supply a first gate clock signal corresponding to the low grayscale area to the gate driver 200, based on the changed data enable signal, and supply a second gate clock signal corresponding to the normal grayscale area to the gate driver 200, based on the reference data enable signal. For example, the timing controller 400' may interpolate the first gate clock signal and the second gate clock signal to generate a third gate clock signal, and supply the third gate clock signal to the gate driver 200 in the interpolation area between the normal grayscale area adjacent to the low grayscale area and the low grayscale area.

The memory 500 (or 500') may store a minimum grayscale reference value and a maximum grayscale reference value with respect to each of the areas A1, A2, and A3 of the display panel 100. In some embodiments, the memory 500 may further store the gate clock signal information according to the grayscale.

The memory 500 (or 500') may provide the timing controller 400 (or 400') with the minimum grayscale reference value and the maximum grayscale reference value with respect to each of the areas A1, A2, and A3 of the display panel 100. In some embodiments, the memory 500 may provide the timing controller 400 with the gate clock signal information according to the grayscale.

Hereinafter, a pixel in accordance with an embodiment of the disclosure is described below with reference to FIG. 3.

Figure 3:
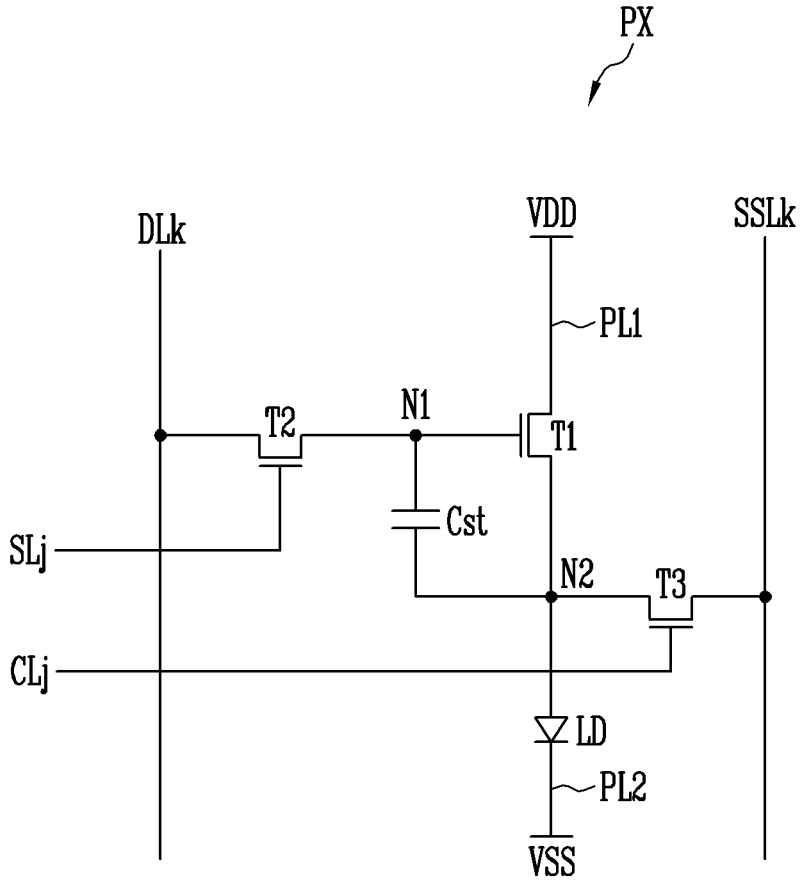
FIG. 3 is a schematic diagram of an equivalent circuit illustrating a pixel included in the display device in accordance with an embodiment of the disclosure.

FIG. 3 is a schematic diagram of an equivalent circuit illustrating a pixel included in the display device in accordance with an embodiment of the disclosure. For convenience of description, a pixel PX located on a jth row (horizontal line) and a kth column is illustrated in FIG. 3.

Referring to FIG. 3, the pixel PX may include a light emitting element LD, a first transistor T1, a second transistor T2, a third transistor T3, and a storage capacitor Cst.

A first electrode (anode or cathode) of the light emitting element LD may be electrically connected to a second node N2, and a second electrode (cathode or anode) of the light emitting element LD may be electrically connected to a second driving voltage VSS through a second power line PL2. The light emitting element LD may generate light with a luminance corresponding to an amount of a current supplied from the first transistor T1.

The light emitting element LD may be a micro light emitting element (LED). For example, the light emitting element LD may be an organic light emitting diode. The light emitting element LD may be a quantum dot light emitting diode. For example, the light emitting element LD may be an element configured with (or including) a combination of an organic material and an inorganic material. In FIG. 3, the pixel PX includes a single light emitting element LD. However, in another embodiment, the pixel PX may include multiple light emitting elements LD, and the light emitting elements LD may be electrically connected in a series, parallel, or series/parallel to each other.

A first electrode of the first transistor T1 (or driving transistor) may be electrically connected to a first driving voltage VDD through a first power line PL1, and a second electrode of the first transistor T1 may be electrically connected the first electrode of the light emitting element LD. For example, the second electrode of the first transistor T1 may be electrically connected to the second node N2. A gate electrode of the first transistor T1 may be electrically connected to a first node N1. The first transistor T1 may control an amount of a current flowing through the light emitting element LD, corresponding to a voltage of the first node N1.

A first electrode of the second transistor T2 may be electrically connected to a data line DLk, and a second electrode of the second transistor T2 may be electrically connected to the first node N1. A gate electrode of the second transistor T2 may be connected to a gate line SLj. The second transistor T2 may be turned on to transfer a data signal from the data line DLk to the first node N1 in case that a gate signal is supplied to the gate line SLj.

The third transistor T3 may be electrically connected between a sensing line SSLk and the second electrode of the first transistor T1 (i.e., the second node N2). For example, a first electrode of the third transistor T3 may be electrically connected to the sensing line SSLk, and a second electrode of the third transistor T3 may be electrically connected to the second electrode of the first transistor T1. A gate electrode of the third transistor T3 may be electrically connected to a control line CLj. The third transistor T3 may be turned on to electrically connect the sensing line SSLk and the second node N2 (e.g., second electrode of first transistor T1) to each other in case that a control signal is supplied to the control line CLj. In case that the third transistor T3 is turned on, an initialization voltage VINT may be supplied to the second node N2, and a sensing current generated from the first transistor T1 may be supplied to the sensing line SSLk.

The storage capacitor Cst may be electrically connected between the first node N1 and the second node N2. The storage capacitor Cst may store a voltage corresponding to a voltage difference between the first node N1 and the second node N2.

In an embodiment, in case that the second transistor T2 is turned on, and a data voltage is applied to the first node N1, the pixel PX may charge the storage capacitor Cst in a period in which a gate signal and a data signal are simultaneously applied. The amount of the current flowing through the light emitting element LD through the first transistor T1 may be changed by a charge amount of the storage capacitor Cst. For example, in case that a deviation occurs in the charge amount of the storage capacitor Cst, brightness of the light emitting element LD may be changed, and a luminance characteristic deviation of the pixel PX may occur. In case that a horizontal cycle of the gate signal applied to the pixel PX is adjusted, the charge amount of the storage capacitor Cst may be controlled, and the luminance characteristic deviation of the pixel PX can be improved. Accordingly, in an embodiment, a gate clock signal based on (e.g., generated based on) the gate signal is controlled, and the luminance characteristic deviation of the pixel PX can be improved.

In the embodiment of the disclosure, the circuit structure of the pixel PX is not limited by FIG. 3. In an example, the light emitting element LD may be located between the first power line PL1 and the first electrode of the first transistor T1. A parasitic capacitor may be formed between the gate electrode of the first transistor T1 (i.e., the first node N1) and a drain electrode of the first transistor T1.

Although a case where the transistors T1, T2, and T3 are implemented with an NMOS transistor is illustrated in FIG. 3, the disclosure is not limited thereto. In an example, at least one of the transistors T1, T2, and T3 may be implemented with a PMOS transistor. The transistors T1, T2, and T3 shown in FIG. 3 may be implemented with a thin film transistor including at least one of an oxide semiconductor, an amorphous silicon semiconductor, and a polycrystalline silicon semiconductor.

Hereinafter, a configuration of the display device in accordance with an embodiment of the disclosure is described below with reference to FIGS. 4 to 6.

Figure 4:
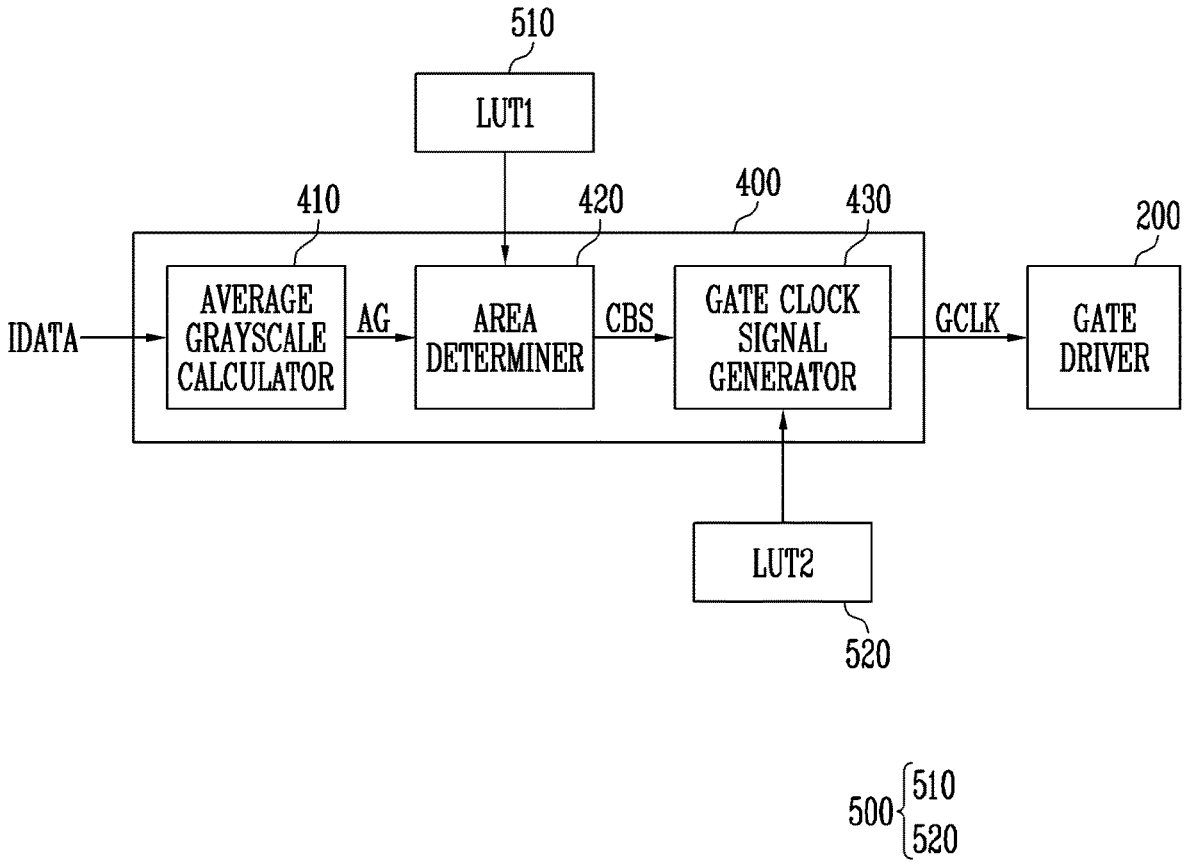
FIG. 4 is a schematic block diagram illustrating a partial configuration of the display device in accordance with an embodiment of the disclosure.

FIG. 4 is a schematic block diagram illustrating a partial configuration of the display device in accordance with an embodiment of the disclosure. FIG. 5 is a schematic timing diagram illustrating signals according to the display device shown in FIG. 4. FIG. 6 is a schematic timing diagram illustrating the timing diagram shown in FIG. 5, which corresponds to each area of the display panel.

Referring to FIG. 4, in accordance with an embodiment, the timing controller 400 may include an average grayscale calculator 410, an area determiner 420, and a gate clock signal generator 430. The memory 500 may include a first lookup table 510 and a second lookup table 520.

Description of the memory 500 is described below. The first lookup table 510 may store a minimum grayscale reference value and a maximum grayscale reference value with respect to each of the areas A1, A2, and A3 (e.g., refer to FIG. 2) of the display panel 100 (e.g., refer to FIG. 2). In an example, each of the minimum grayscale reference value and the maximum grayscale reference value may include a grayscale value corresponding to each of a red sub-pixel, a green sub-pixel, and a blue sub-pixel, which constitute each pixel PX (e.g., refer to FIG. 3). For example, in a first area A1 (e.g., refer to FIG. 5) of the display panel 100, grayscale 25 may be set as the minimum grayscale reference value, and grayscale 80 may be set as the maximum grayscale reference value. In a second area A2 (e.g., refer to FIG. 5) of the display panel 100, grayscale 100 may be set as the minimum grayscale reference value, and grayscale 220 may be set as the maximum grayscale reference value. These numerical values are merely illustrative, and grayscale reference values may be variously changed.

The second lookup table 520 may store gate clock signal information according to a grayscale. Gate clock signal information according to low grayscales smaller than a low grayscale reference value in the gate clock signal information may designated as first gate clock signal information. Gate clock signal information according to normal grayscales greater than the reference value in the gate clock signal information may be designated as second gate clock signal information. For example, the second gate clock signal information may be gate clock signal information based on input image data IDATA. The first gate clock signal information may be gate clock signal information obtained by shifting the gate clock signal information based on the input image data IDATA by a horizontal cycle. In an embodiment, a horizontal cycle of a first gate clock signal may be longer than a horizontal cycle of a second gate clock signal. Accordingly, pixels PX to which a gate signal based on (e.g., generated based on) the first gate clock signal is applied may have a charge time longer than a charge time of pixels PX to which a gate signal based on (e.g., generated based on) the second gate clock signal is applied.

The information stored in the first lookup table 510 and the second lookup table 520 may be predetermined information.

The average grayscale calculator 410 may receive input image data IDATA, and calculate an average grayscale values AG with respect to the areas A1, A2, and A3 (e.g., refer to FIG. 2) of the display panel 100 (e.g., refer to FIG. 2).

The areas A1, A2, and A3 of the display panel 100 (e.g., refer to FIG. 2) may correspond to areas adjacent to each other in the first direction DR1 (or vertical direction), which are divided according to a reference as described with reference to FIG. 2. At least one data line DL1 to DLm (e.g., refer to FIG. 1) may be disposed in each area of the display panel 100, and a data signal may be supplied to each data line. The data signal supplied to each data line is generated based on the input image data IDATA, and a grayscale with respect to each area (or data lines DL1 to DLm of FIG. 1) of the display panel 100 may be predicted (or calculated) through an input grayscale of the input image data IDATA. Accordingly, the average grayscale calculator 410 may calculate the average grayscale values AG with respect to the areas A1, A2, and A3 (e.g., refer to FIG. 2) of the display panel 100 through the input image data IDATA.

The input image data IDATA may have input grayscale values respectively corresponding to the data lines DL1 to DLm (e.g., refer to FIG. 1). Accordingly, the average grayscale calculator 410 may calculate the average grayscale values AG with respect to input grayscale values applied to data lines DL1 to DLm disposed in each area of the display panel 100 (e.g., refer to FIG. 1).

The area determiner 420 may receive the average grayscale values AG from the average grayscale calculator 410.

The area determiner 420 may compare the average grayscale value AG with respect to the areas A1, A2, and A3 of the display panel 100 to determine a low grayscale area among the areas A1, A2, and A3 (e.g., refer to FIG. 2) of the display panel 100 (e.g., refer to FIG. 2). Thus, the area determiner 420 may output a charge boosting signal CBS.

The area determiner 420 may determine, as the low grayscale area, an area having a value smaller than the low grayscale reference value among the average grayscale values AG. For example, the low grayscale area may be an area among the areas A1, A2, and A3 (e.g., refer to FIG. 2) of the display panel 100 (e.g., refer to FIG. 2). For example, the low grayscale area may be multiple areas A1, A2, and A3 among the areas A1, A2, and A3 of the display panel 100. An area except the low grayscale area among the areas A1, A2, and A3 of the display panel 100 may be referred to as a normal area.

For example, the area determiner 420 may receive minimum grayscale reference values and maximum grayscale reference values from the first lookup table 510.

The area determiner 420 may consider a minimum grayscale value and a maximum grayscale value with respect to each area, in case that the area determiner 420 determines the low grayscale area among the areas A1, A2, and A3 (e.g., refer to FIG. 2) of the display panel 100 (e.g., refer to FIG. 2). For example, in case that an area is determined as the low grayscale area, the area determiner 420 may compare a minimum grayscale value and a maximum grayscale value of the corresponding area respectively with the minimum grayscale reference value and the maximum grayscale reference value.

In case that an area corresponds to an area having a value smaller than the low grayscale reference value among the average grayscale values AG, a minimum grayscale value with respect to the corresponding area is equal to or greater than the minimum grayscale reference value, and a maximum grayscale value with respect to the corresponding area is equal to or smaller than the maximum grayscale reference value, the area determiner 420 may determine the corresponding area as the low grayscale area. For example, the area determiner 420 may determine the corresponding area as the low grayscale area in case that the corresponding area has the value smaller than the low grayscale reference value among the average grayscale value AG, and has the minimum grayscale value equal to or greater than the minimum grayscale reference value and the maximum grayscale value equal to or smaller than the maximum grayscale reference value.

Although an area corresponds to an area having a value smaller than the low grayscale reference value among the average grayscale values AG, in case that a minimum grayscale value with respect to the corresponding area is equal to or smaller than the minimum grayscale reference value and a maximum grayscale value with respect to the corresponding area is equal to or greater than the maximum grayscale reference value, the area determiner 420 may not determine the corresponding area as the low grayscale area. For example, the area determiner 420 may not determine the corresponding area as the low grayscale area in case that the corresponding area has the value smaller than the low grayscale reference value among the average grayscale values AG, and has the minimum gray scale value equal to or smaller than the minimum grayscale reference value and the maximum grayscale value equal to or greater than the maximum grayscale reference value. For example, in case that a minimum grayscale reference value with respect to an area is grayscale 40 and a maximum grayscale reference value with respect to the area is grayscale 60, the area determiner 420 may not determine the area as the low grayscale area, in case that a minimum grayscale value with respect to the area is grayscale 0 and a maximum grayscale value with respect to the area is grayscale 100, in case that a low grayscale reference value with respect to the area is grayscale 60 and an average grayscale value AG with respect to the area is grayscale 50. For example, the area determiner 420 may not determine the area as the low grayscale area, in case that the minimum grayscale reference, the maximum grayscale reference value, the minimum grayscale value, the maximum grayscale value, the low grayscale reference value, and the average grayscale value AG are grayscale 40, grayscale 60, grayscale 0, grayscale 100, grayscale 60, grayscale 50, respectively. Accordingly, in the display device in accordance with the embodiment of the disclosure, the low grayscale area may be accurately determined by considering (or based on) together an average grayscale value, a minimum grayscale value, and a maximum grayscale value with respect to each area.

The gate clock signal generator 430 may receive the charge boosting signal CBS from the area determiner 420, receive the gate clock signal information according to grayscale (e.g., grayscale value) from the second lookup table 520, and generate gate clock signals GCLK corresponding to each area by reflecting (or based on) the charge boosting signal CBS and the gate clock signal information according to grayscale. Thus, the gate clock signal generator 430 may supply the gate clock signals GCLK to the gate driver 200.

The charge boosting signal CBS may include grayscale information on the areas A1, A2, and A3 (e.g., refer to FIG. 2) of the display panel 100 (e.g., refer to FIG. 2). Accordingly, the gate clock signal generator 430 may check whether each of the areas A1, A2, and A3 of the display panel 100 is a low grayscale area or a normal grayscale area according to the charge boosting signal CBS, and generate a gate clock signal GCLK corresponding to the low grayscale area or the normal grayscale area. For example, the charge boosting signal CBS may have a value of 1, 0, 0, and the gate clock signal generator 430 may check that the areas A1, A2, and A3 of the display panel 100 are three areas A1, A2, and A3 including a first area A1 (e.g., refer to FIG. 5) corresponding to a low grayscale area. For example, the gate clock signal generator 430 may generate a gate clock signal corresponding to a low grayscale in the first area A1, and generate gate clock signals corresponding to a normal grayscale area in second and third areas A2 and A3 (e.g., refer to FIG. 2).

For example, with respect to the first area A1 (e.g., refer to FIG. 5), the gate clock signal generator 430 may generate a first gate clock signal corresponding to a low grayscale area, based on the first gate clock signal information in the gate clock signal information according to the grayscale (e.g., grayscale value), which is received from the second lookup table 520. For example, the gate clock signal generator 430 may generate the first gate clock signal corresponding to the low grayscale area based on the first gate clock signal information with respect to the first area A1, and the first gate clock signal information may be in the gate clock signal information according to the grayscale (e.g., grayscale value) received from the second lookup table 520.

With respect to the second area A2 (e.g., refer to FIG. 5), the gate clock signal generator 430 may generate a second gate clock signal such that the second gate clock signal information in the gate clock signal information according to the grayscale (e.g., grayscale value), which is received from the second lookup table 520, is supplied to a normal grayscale area.

For example, the gate clock signal generator 430 may generate a third gate clock signal. The gate clock signal generator 430 may interpolate the first gate clock signal information and the second gate clock signal information to obtain gate clock signal information, and the gate clock signal information may be supplied to an interpolation area between the low grayscale area (or first area A1) and the normal grayscale area (or second area A2) adjacent to the low grayscale area. For example, the gate clock signal generator 430 may interpolate the first gate clock signal information and the second gate clock signal information to generate the third gate clock signal, and the third gate clock signal may be supplied to the interpolation area between the low grayscale area (or first area A1) and the normal grayscale area (or second area A2) adjacent to the low grayscale area.

The gate driver 200 may receive the gate clock signal GCLK from the gate clock signal generator 430, and supply the gate signal based on the gate clock signal GCLK to the display panel 100 (e.g., refer to FIG. 1).

For example, the gate driver 200 may supply a first gate signal to the low grayscale area of the display panel 100 (e.g., refer to FIG. 1), based on the first gate clock signal, supply a second gate signal to the normal grayscale area of the display panel 100, based on the second gate clock signal, and supply a third gate signal to the interpolation area of the display panel 100, based on the third gate clock signal. In an embodiment, since the first gate signal, the second gate signal, and the third gate signal are based on the first gate clock signal, the second gate clock signal, and the third gate clock signal, a horizontal cycle of the first gate signal may be longer than a horizontal cycle of the second gate signal, and a horizontal cycle of the third gate signal may be shorter than the horizontal cycle of the first gate signal and be longer than the horizontal cycle of the second gate signal. Accordingly, in an embodiment, a gate signal based on (e.g., generated based on) a low grayscale gate clock signal may be supplied to the low grayscale area of the display panel 100, so that pixels of the normal grayscale area and pixels of the low grayscale area may have charge times equal to or similar to each other. Accordingly, in the display device in accordance with the embodiment of the disclosure, a luminance characteristic of the display panel 100 may be improved.

Figure 5:
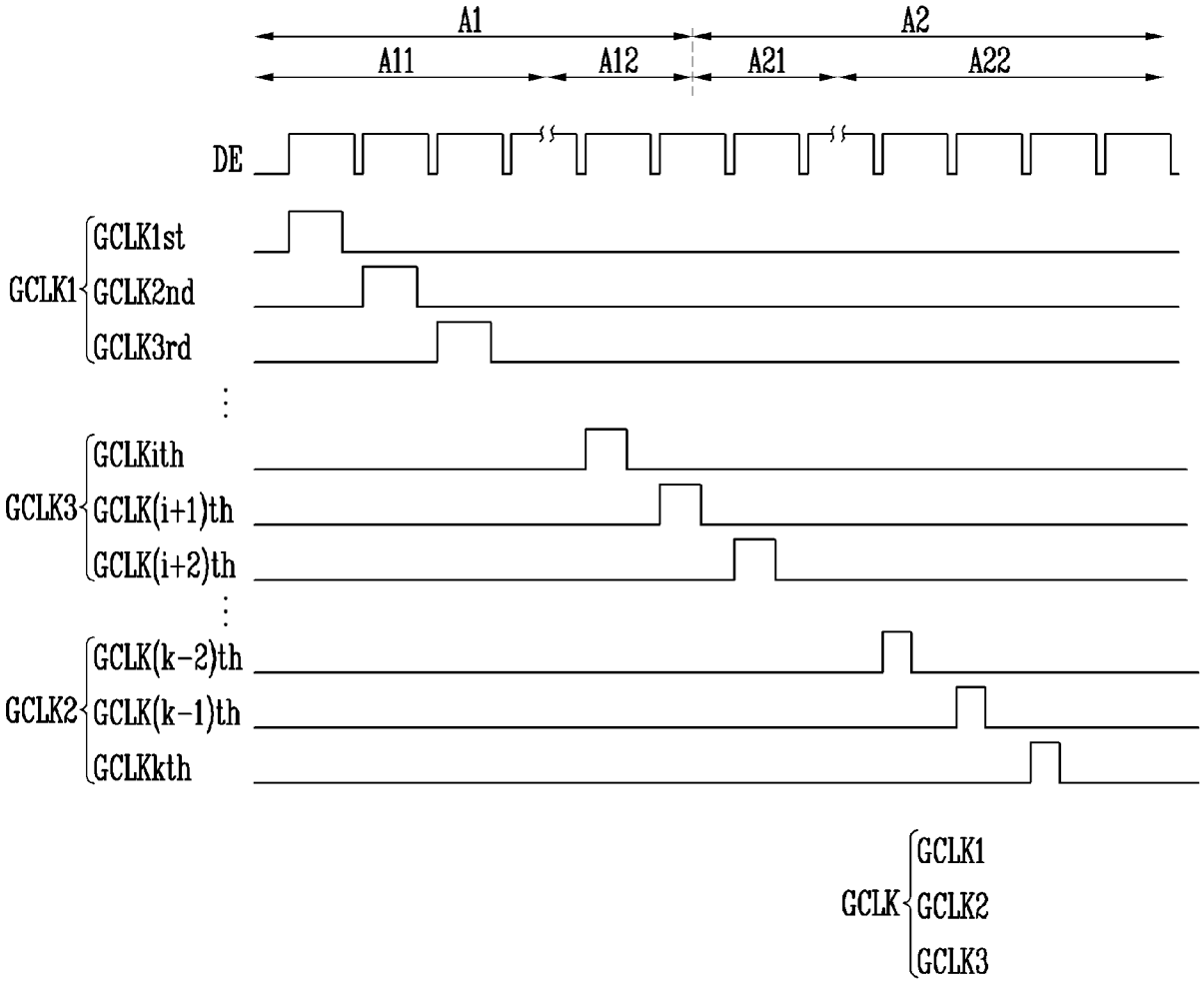
FIG. 5 is a schematic timing diagram illustrating signals according to the display device shown in FIG. 4.
Figure 6:
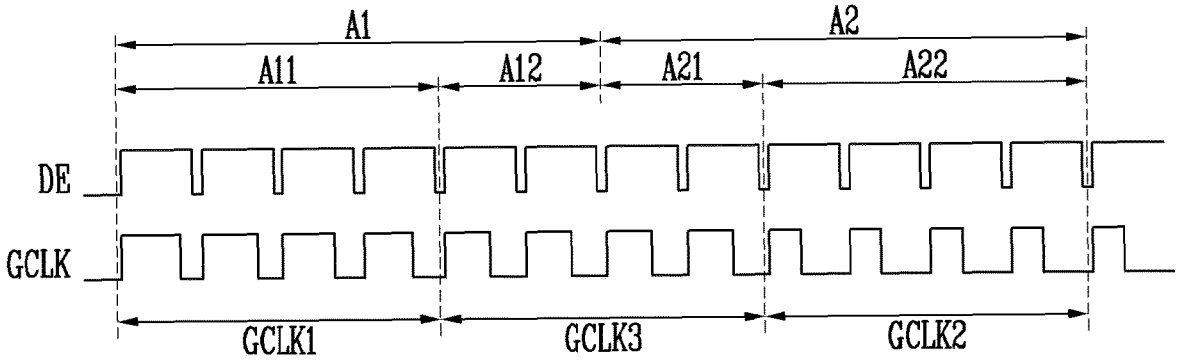
FIG. 6 is a schematic timing diagram illustrating the timing diagram shown in FIG. 5, which corresponds to each area of the display panel.

FIGS. 5 and 6 illustrate a data enable signal DE and gate clock signals GCLK, which are applied to the first area A1 and the second area A2 in case that the display panel 100 described with reference to FIG. 2 includes the first area A1, the second area A2, and the third area A3. The first area A1 may be a low grayscale area determined by the area determiner 420, and the second area A2 may be a normal area. The (1-2)th sub-area A12 and the (2-1)th sub-area A21 may be an interpolation area between the low grayscale area and the normal grayscale area.

Referring to FIG. 5, the data enable signal DE may be output in a cycle. The gate clock signals GCLK may have a cycle equal to the cycle of the data enable signal DE, and rise in synchronization with a rising time of the data enable signal DE. The gate clock signals GCLK may be sequentially output in a row direction to correspond to the gate signals supplied to the gate lines SL1 to SLn (refer to FIG. 1) of the display panel 100 (e.g., refer to FIG. 1). First to kth gate clock signals GCLK1st to GCLKkth may respectively correspond to gate signals supplied to first to kth gate lines. For example, the gate signals may be sequentially applied to the first to kth gate lines of the display panel 100, based on the first to kth gate clock signals GCLK1st to GCLKkth (e.g., gate signals supplied to gate lines).

Gate signals respectively based on a first gate clock signal GCLK1st, a second gate clock signal GCLK2nd, and a third gate clock signal GCLK3rd (e.g., gate signals supplied to gate lines) may be supplied to the (1-1)th sub-area A11. The first gate clock signal GCLK1st, the second gate clock signal GCLK2nd, and the third gate clock signal GCLK3rd (e.g., gate signals supplied to gate lines) may correspond to a portion of a first gate clock signal GCLK1.

Gate signals respectively based on a (k−2)th gate clock signal GCLK(k−2)th, a (k−1)th gate clock signal GCLK(k−1)th, and a kth gate clock signal GCLKkth (e.g., gate signals supplied to gate lines) may be supplied to the (2-2)th sub-area A22. The (k−2)th gate clock signal GCLK(k−2)th, the (k−1)th gate clock signal GCLK(k−1)th, and the kth gate clock signal GCLKkth (e.g., gate signals supplied to gate lines) may correspond to a portion of a second gate clock signal GCLK2.

In an example, the (1-1)th sub-area A11 may correspond to the low grayscale area, and the first gate clock signal GCLK1 corresponding to the (1-1)th sub-area A11 may have a horizontal cycle longer than a horizontal cycle (or horizontal period) of the second gate clock signal GCLK2 corresponding to the (2-2)th sub-area A22. For example, in an embodiment, a horizontal cycle of gate clock signals corresponding to the low grayscale area is longer than a horizontal cycle of gate clock signals corresponding to the normal grayscale area, and therefore, a charge time of pixels disposed in the low grayscale area may be longer than a charge time of pixels disposed in the normal grayscale area. Accordingly, the pixels of the normal grayscale area and the pixels of the low grayscale area may have charge times equal to or similar to each other. Thus, in the display device in accordance with the embodiment of the disclosure, the luminance characteristic of the display panel 100 (e.g., refer to FIG. 2) may be improved.

Gate signals respectively based on an ith gate clock signal GCLKith, an (i+1)th gate clock signal GCLK(i+1)th, and an (i+2)th gate clock signal GCLK(i+2)th (e.g., gate signals supplied to gate lines) may be supplied to the (1-2)th sub-area A12 and the (2-1)th sub-area A21. The ith gate clock signal GCLKith, the (i+1)th gate clock signal GCLK(i+1)th, and the (i+2)th gate clock signal GCLK(i+2)th (e.g., gate signals supplied to gate lines) may correspond to a portion of a third gate clock signal GCLK3.

In an example, the (1-1)th sub-area A11 may correspond to a low grayscale area. The (2-2)th sub-area A22 may correspond to a normal grayscale area. The (1-2)th sub-area A12 and the (2-1)th sub-area A21 may correspond to an interpolation area between the low grayscale area and the normal grayscale area. A horizontal cycle of the third gate clock signal GCLK3 corresponding to the (1-2)th sub-area A12 and the (2-1)th sub-area A21 may be shorter than a horizontal cycle of the first gate clock signal GCLK1, and be longer than a horizontal cycle of the second gate clock signal GCLK2. For example, in an embodiment, a horizontal cycle of gate clock signals corresponding to the interpolation area may be between a horizontal cycle of gate clock signals corresponding to the low grayscale area and a horizontal cycle of gate clock signals corresponding to the normal grayscale area. A charge time of pixels disposed in the interpolation area may be between a charge time of pixels disposed in the low grayscale area and a charge time of pixels disposed in the normal grayscale area. Accordingly, the pixels of the interpolation area may smoothly improve the luminance characteristic of the display panel 100 (e.g., refer to FIG. 2) between the low grayscale area and the normal grayscale area.

Referring to FIG. 6, the data enable signal DE may be output in a cycle. The gate clock signals GCLK may have a cycle equal to the cycle of the data enable signal DE, and rise in synchronization with a rising time of the data enable signal DE. In FIG. 6, gate clock signals corresponding to a gate signal applied to a gate line in each area among gate signals applied to the first area A1 and the second area A2 are illustrated as a horizontal line (e.g., square wave shape).

A gate signal (e.g., first to third gate clock signals GCLK1st, GCLK2nd, and GCLK3rd) based on (e.g., generated based on) a first gate clock signal GCLK1 may be supplied to the (1-1)th sub-area all. In an example, the (1-1)th sub-area A11 may correspond to a low grayscale area, and the first gate clock signal GCLK1 may be a signal based on (e.g., generated based on) the first gate clock signal information received through the second lookup table 520.

A gate signal (e.g., (k−2)th to kth gate clock signals GCLK(k−2)th , GCLK(k−1)th, and GCLKkth) based on (e.g., generated based on) a second gate clock signal GCLK2 may be supplied to the (2-2)th sub-area A22. In an example, the (2-2)th sub-area A22 may correspond to a normal grayscale area, and the second gate clock signal GCLK2 may be a signal based on (e.g., generated based on) the second gate clock signal information received through the second lookup table 520.

A gate signal (e.g., ith to (i−2)th gate clock signals GCLKith, GCLK(i+1)th, and GCLK(i+2)th) based on (e.g., generated based on) a third gate clock signal GCLK3 may be supplied to the (1-2)th sub-area A12 and the (2-1)th sub-area A21. In an example, the (1-2)th sub-area A12 and the (2-1)th sub-area A21 may correspond to an interpolation area. The first gate clock signal GCLK1 and the second gate clock signal GCLK2 may be interpolated to obtain the third gate clock signal GCLK3.

In an example, a horizontal cycle of the first gate clock signal GCLK1 may be longer than a horizontal cycle of the second gate clock signal GCLK2. Accordingly, pixels of the normal grayscale area and pixels of the low grayscale area may have charge times equal to or similar to each other. Thus, in the display device in accordance with the embodiment of the disclosure, the luminance characteristic of the display panel 100 (e.g., refer to FIG. 2) may be improved.

A horizontal cycle of the third gate clock signal GCLK3 may be shorter than the horizontal cycle of the first gate clock signal GCLK1, and be longer than the horizontal cycle of the second gate clock signal GCLK2. Accordingly, a charge time of pixels of the interpolation area may be between the charge time of the pixels disposed in the low grayscale area and the charge time of the pixels disposed in the normal grayscale area. The pixels of the interpolation area may smoothly improve the luminance characteristic of the display panel 100 (e.g., refer to FIG. 2) between the low grayscale area and the normal grayscale area.

Hereinafter, a configuration of the display device in accordance with an embodiment of the disclosure is described below in detail with reference to FIGS. 7 to 9.

Figure 7:
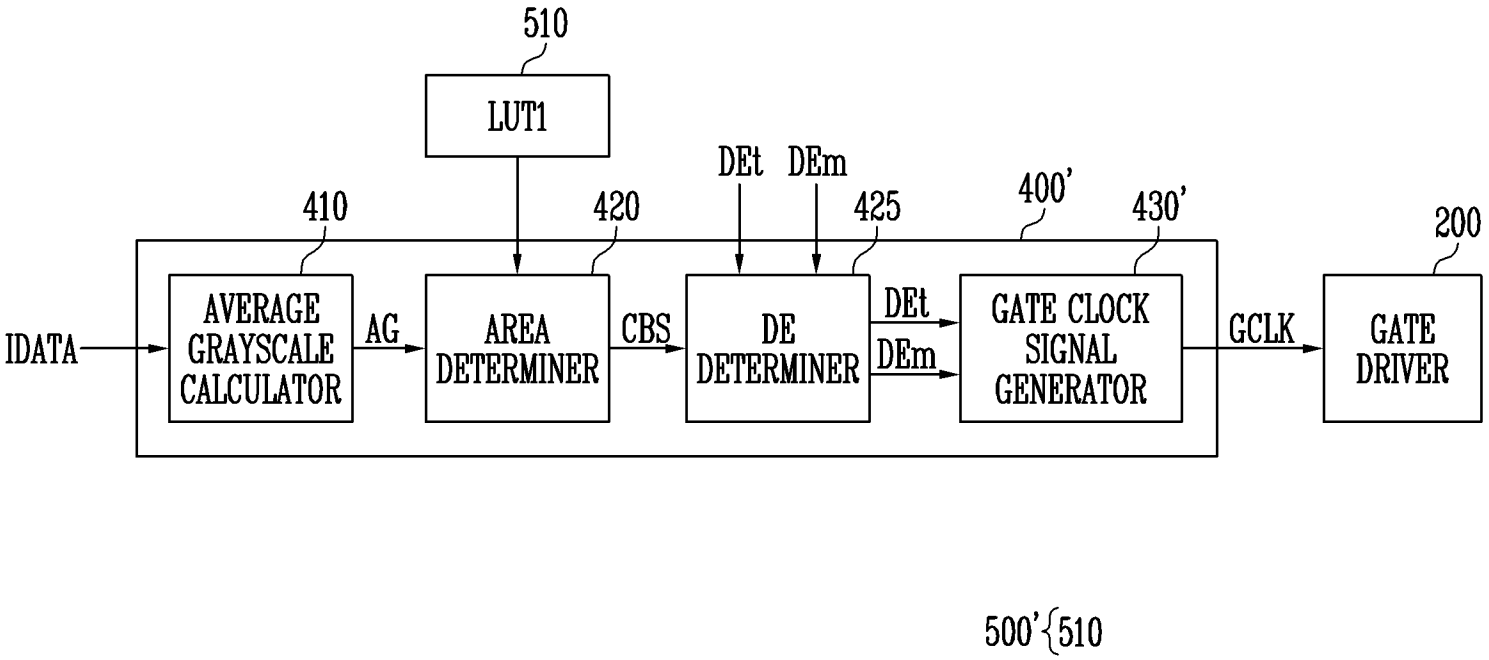
FIG. 7 is a schematic block diagram illustrating a partial configuration of the display device in accordance with an embodiment of the disclosure.

FIG. 7 is a schematic block diagram illustrating a partial configuration of the display device in accordance with an embodiment of the disclosure. FIG. 8 is a schematic timing diagram illustrating signals according to the display device shown in FIG. 7 in accordance with an embodiment of the disclosure. FIG. 9 is a schematic timing diagram illustrating the timing diagram shown in FIG. 8, which corresponds to each area of the display panel.

Referring to FIG. 7, in accordance with an embodiment, a timing controller 400' may include an average grayscale calculator 410, an area determiner 420, a DE determiner 425, and a gate clock signal generator 430'. A memory 500' may include a first lookup table 510. The configuration shown in FIG. 7 is similar to the configuration shown in FIG. 4. Therefore, hereinafter, detailed descriptions of the same constituent elements is omitted, and portions different from those shown in FIG. 4 are described.

The average grayscale calculator 410 may receive input image data IDATA, and calculate average grayscale values AG with respect to the areas A1, A2, and A3 (e.g., refer to FIG. 2) of a display panel 100 (e.g., refer to FIG. 2).

The area determiner 420 may receive the average grayscale values AG, and compare the average grayscale values AG with respect to the areas A1, A2, and A3 of the display panel 100 (e.g., refer to FIG. 2) with a low grayscale reference value to determine a low grayscale area among the areas A1, A2, and A3 (e.g., refer to FIG. 2) of the display panel 100 (e.g., refer to FIG. 2). Thus, the area determiner 420 may output a charge boosting signal CBS. For example, the area determiner 420 may receive a minimum grayscale reference value and a maximum grayscale reference value with respect to the areas A1, A2, and A3 of the display panel 100, and may determine a low grayscale area by considering (or based on) a minimum grayscale value and a maximum grayscale value with respect to each area.

The DE determiner 425 may receive the charge boosting signal CBS from the area determiner 420, and receive a data enable signal from the outside. The data enable signal may include a reference data enable signal DEt and a modified data enable signal DEm. The reference enable signal DEt may be supplied to the DE determiner 425 in synchronization of the input image data IDATA. The modified data enable signal DEm may have a horizontal cycle different from a horizontal cycle of the reference data enable signal DEt, and the horizontal cycle of the modified data enable signal DEm may be longer than the horizontal cycle of the reference data enable signal DEt.

The DE determiner 425 may output a data enable signal to the gate clock signal generator 430' with respect to each area according to grayscale information of each area, based on the charge boosting signal CBS.

The DE determiner 425 may output the modified data enable signal DEm corresponding to the low grayscale area to the gate clock signal generator 430', and output the reference data enable signal DEt corresponding to a normal grayscale area to the gate clock signal generator 430'.

The gate clock signal generator 430' may generate a second gate clock signal corresponding to the normal grayscale area, based on the reference data enable signal DEt, and generate a first gate clock signal corresponding to the low grayscale area, based on the modified data enable signal DEm. For example, the gate clock signal generator 430' may interpolate the first gate clock signal and the second gate clock signal to generate a third gate clock signal, which corresponds to an interpolation area.

In accordance with an embodiment, the timing controller 400' may modify the data enable signal according to a grayscale (e.g., grayscale value) without any separate memory to generate a gate clock signal. Accordingly, in the display device shown in FIG. 7, the configuration of the timing controller 400' may be simplified, thereby improving the luminance characteristic of the display panel 100 (e.g., refer to FIG. 1).

Figure 8:
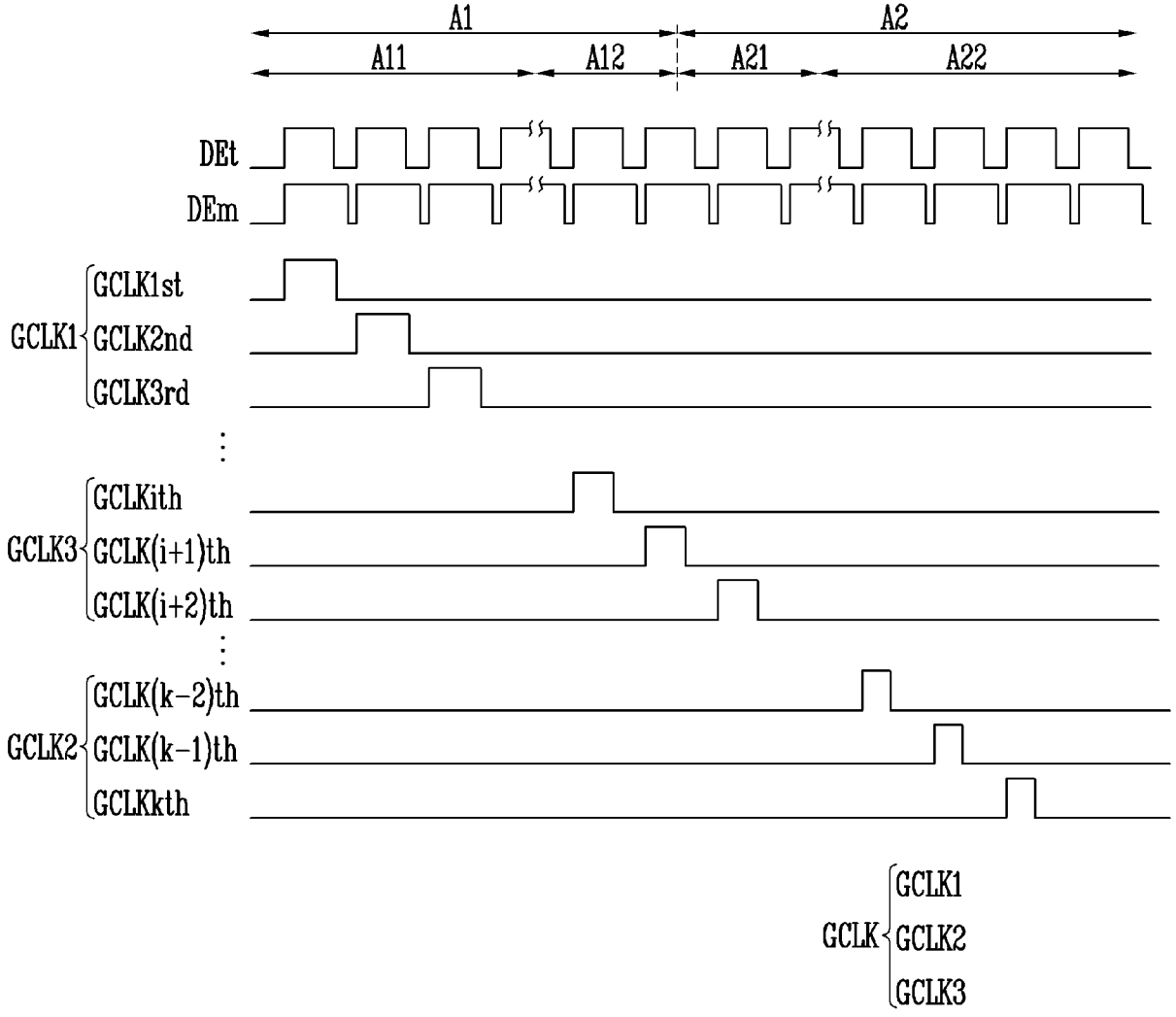
FIG. 8 is a schematic timing diagram illustrating signals according to the display device shown in FIG. 7 in accordance with an embodiment of the disclosure.
Figure 9:
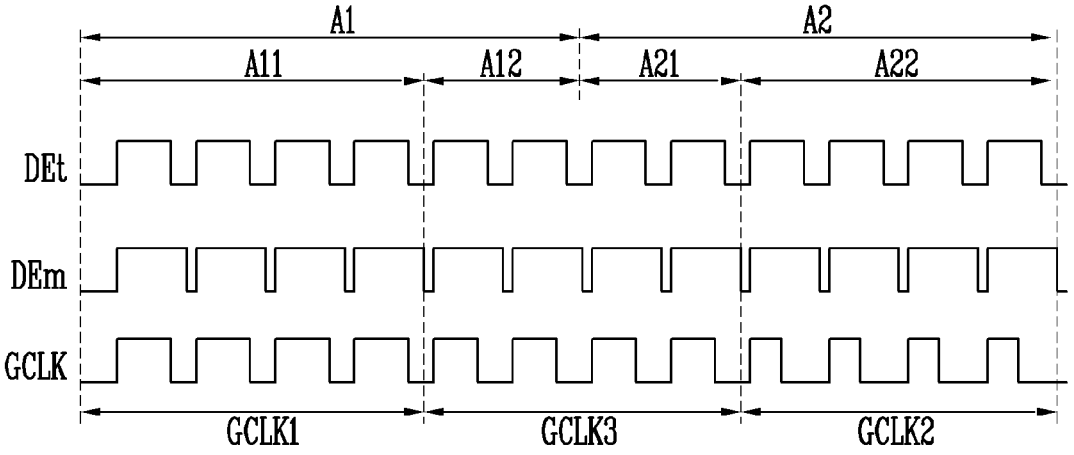
FIG. 9 is a schematic timing diagram illustrating the timing diagram shown in FIG. 8, which corresponds to each area of the display panel.

FIGS. 8 and 9 illustrate a data enable signal DEt and DEm and gate clock signals GCLK, which are applied to the first area A1 and the second area A2, in case that the display panel 100 described with reference to FIG. 2 includes the first area A1, the second area A2, and the third area A3. The first area A1 may be a low grayscale area determined by the area determiner 420, and the second area A2 may be a normal area. The (1-2)th sub-area A12 and the (2-1)th sub-area A21 may be an interpolation area between the low grayscale area and the normal grayscale area.

Referring to FIG. 8, a modified data enable signal DEm and a reference data enable signal DEt may be output in a cycle. The modified data enable signal DEm and the reference data enable signal DEt may have different horizontal cycles. In an embodiment, a horizontal cycle of the modified data enable signal DEm may be longer than a horizontal cycle of the reference data enable signal DEt.

Gate signals respectively based on a first gate clock signal GCLK1st, a second gate clock signal GCLK2nd, and a third gate clock signal GCLK3rd (e.g., gate signals supplied to gate lines) may be supplied to the (1-1)th sub-area A11. The first gate clock signal GCLK1st, the second gate clock signal GCLK2nd, and the third gate clock signal GCLK3rd (e.g., gate signals supplied to gate lines) may correspond to a portion of a first gate clock signal GCLK1.

In an example, the (1-1)th area A11 may correspond to a low grayscale area, and the first gate clock signal GCLK1 corresponding to the (1-1)th sub-area A11 may be generated based on the modified data enable signal DEm.

Gate signals respectively based on a (k−2)th gate clock signal GCLK(k−2)th, a (k−1)th gate clock signal GCLK(k−1)th, and a kth gate clock signal GCLKkth (e.g., gate signals supplied to gate lines) may be supplied to the (2-2)th sub-area A22. The (k−2)th gate clock signal GCLK(k−2)th, the (k−1)th gate clock signal GCLK(k−1)th, and the kth gate clock signal GCLKkth (e.g., gate signals supplied to gate lines) may correspond to a portion of a second gate clock signal GCLK2.

In an example, the (2-2)th sub-area A22 may correspond to a normal grayscale area, and the second gate clock signal GCLK2 corresponding to the (2-2)th sub-area A22 may be generated based on the reference data enable signal DEt.

Gate signals respectively based on an ith gate clock signal GCLKith, an (i+1)th gate clock signal GCLK(i+1)th, and an (i+2)th gate clock signal GCLK(i+2)th (e.g., gate signals supplied to gate lines) may be supplied to the (1-2)th sub-area A12 and the (2-1)th sub-area A21. The ith gate clock signal GCLKith, the (i+1)th gate clock signal GCLK (i+1)th, and the (i+2)th gate clock signal GCLK(i+2)th (e.g., gate signals supplied to gate lines) may correspond to a portion of a third gate clock signal GCLK3.

In an example, the (1-2)th sub-area A12 and the (2-1)th sub-area A21 may correspond to an interpolation area. The first gate clock signal GCLK1 corresponding to the (1-1)th sub-area A11 and the second gate clock signal GCLK2 corresponding to the (2-2)th sub-area A22 may be interpolated to obtain the third gate clock signal GCLK3 corresponding to the (1-2)th sub-area A12 and the (2-1)th sub-area A21.

The first gate clock signal GCLK1 corresponding to the (1-1)th sub-area A11 may have a horizontal cycle longer than a horizontal cycle of the second gate clock signal GCLK2 corresponding to the (2-2)th sub-area A22. For example, in an embodiment, since a horizontal cycle of gate clock signals corresponding to the low grayscale area is longer than a horizontal cycle of gate clock signals corresponding to the normal grayscale area, a charge time of pixels disposed in the low grayscale area may be longer than a charge time of pixels disposed in the normal grayscale area. Accordingly, the pixels of the normal grayscale area and the pixels of the low grayscale area may have charge times equal or similar to each other. Thus, in the display device in accordance with the embodiment of the disclosure, the luminance characteristic of the display panel 100 may be improved.

A horizontal cycle of the third gate clock signal GCLK3 corresponding to the (1-2)th sub-area A12 and the (2-1)th sub-area A21 may be shorter than the horizontal cycle of the first gate clock signal GCLK1, and be longer than the horizontal cycle of the second gate clock signal GCLK2. For example, in an embodiment, since a horizontal cycle of gate clock signals corresponding to the interpolation area is between the horizontal cycle of the gate clock signals corresponding to the low grayscale area and the horizontal cycle of the gate clock signals corresponding to the normal grayscale area, a charge time of pixels disposed in the interpolation area may be between the charge time of the pixels disposed in the low grayscale area and the charge time of the pixels disposed in the normal grayscale area. Accordingly, the pixels of the interpolation area may smoothly improve the luminance characteristic of the display panel 100 between the low grayscale area and the normal grayscale area.

Referring to FIG. 9, a gate signal (e.g., first to third gate clock signals GCLK1st, GCLK2nd, and GCLK3rd) corresponding to the first gate clock signal GCLK1 may be supplied to the (1-1)th sub-area A11, based on the modified data enable signal DEm. In an example, the (1-1)th sub-area A11 may correspond to a low grayscale area, and the first gate clock signal GCLK1 may be a gate clock signal shifted from a gate clock signal based on (e.g., generated based on) the input image data IDATA.

A gate signal (e.g., (k−2)th to kth gate clock signals GCLK(k−2)th, GCLK(k−1)th, and GCLKkith corresponding to the second gate clock signal GCLK2 may be supplied to the (2-2)th sub-area A22, based on the reference data enable signal DEt. In an example, the (2-2)th sub-area A22 may correspond to a normal grayscale area, and the second gate clock signal GCLK2 may be a gate clock signal based on (e.g., generated based on) the input image data IDATA.

A gate signal (e.g., (i+2)th to ith gate clock signals GCLKith, GCLK(i+1)th, and GCLK(i+2)th corresponding to the third gate clock signal GCLK3 may be supplied to the (1-2)th sub-area A12 and the (2-1)th sub-area A21. In an example, the (1-2)th sub-area A12 and the (2-1)th sub-area A21 may correspond to an interpolation area, and the first gate clock signal GCLK1 and the second gate clock signal GCLK2 may be interpolated to obtain the third gate clock signal GCLK3.

In an example, a horizontal cycle of the first gate clock signal GCLK1 may be longer than a horizontal cycle of the second gate clock signal GCLK2. Accordingly, pixels of the normal grayscale area and pixels of the low grayscale area may have charge times equal to or similar to each other. Thus, in the display device in accordance with the embodiment of the disclosure, the luminance characteristic of the display panel 100 (e.g., refer to FIG. 2) may be improved.

A horizontal cycle of the third gate clock signal GCLK3 may be shorter than the horizontal cycle of the first gate clock signal GCLK1, and be longer than the horizontal cycle of the second gate clock signal GCLK2. Accordingly, a charge time of pixels of the interpolation area may be between the charge time of the pixels disposed in the low grayscale area and the charge time of the pixels disposed in the normal grayscale area. The pixels of the interpolation area may smoothly improve the luminance characteristic of the display panel 100 (e.g., refer to FIG. 2) between the low grayscale area and the normal grayscale area.

Hereinafter, a driving method of the display device in accordance with an embodiment of the disclosure is described below with reference to FIG. 10.

Figure 10:
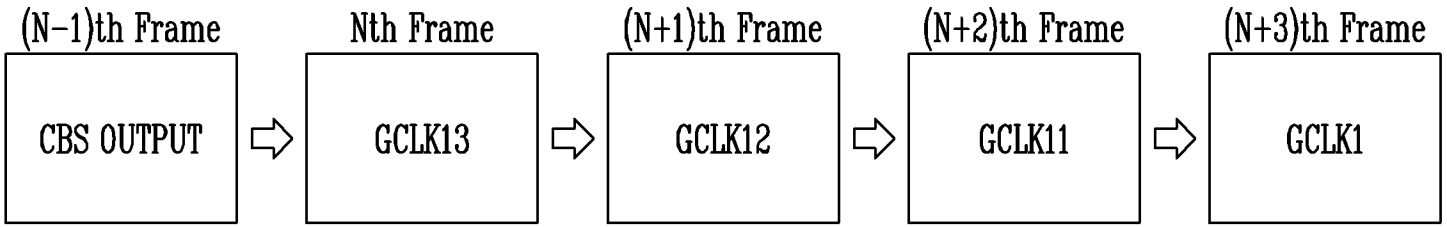
FIG. 10 is a schematic diagram illustrating a driving method of the display device in case that the display panel is driven in frames in accordance with an embodiment of the disclosure.

FIG. 10 is a schematic diagram illustrating a driving method of the display device in case that the display panel is driven in frames in accordance with an embodiment of the disclosure. The driving method shown in FIG. 10 is described below with reference to the above-described FIGS. 1 to 9 together.

Referring to FIG. 10, in case that an image of a display panel 100 (e.g., refer to FIG. 1) is displayed in units of frames, a timing controller 400 (or 400') in accordance with the embodiment of the disclosure may sequentially drive each component of the timing controller 400 (or 400') for every frame, thereby preventing viewing of a change in image quality due to a change in charge time.

For example, in an (n−1)th frame (N−1)th Frame, an average grayscale calculator 410 may calculate average grayscale values AG with respect to areas A1, A2, and A3 (e.g., refer to FIG. 2) of a display panel 100 (e.g., refer to FIG. 2), and an area determiner 420 may determine a low grayscale area among the areas A1, A2, and A3 of the display panel 100 and output a charge boosting signal CBS.

A gate clock signal generator 430 (or 430') may generate a first gate clock signal GCLK1 throughout an nth frame Nth Frame, an (n+1)th frame (N+1)th Frame, an (n+2)th frame (N+)th Frame, and an (n+3)th frame (N+3)th Frame with respect to a low grayscale area among the areas A1, A2, and A3 (e.g., refer to FIG. 2) of the display panel 100 (e.g., refer to FIG. 2). For example, the gate clock signal generator 430 (or 430') may generate the first gate clock signal GCLK1 corresponding to the low grayscale area among the areas A1, A2, and A3 (e.g., refer to FIG. 2) of the display panel 100, and the first gate clock signal GCLK1 may be generated through the nth frame Nth Frame, the (n+1)th frame (N+1)th Frame, the (n+2)th frame (N+)th Frame, and the (n+3)th frame (N+3)th Frame.

The gate clock signal generator 430 may allow a gate clock signal to be gradually changed to a (1-3)th gate clock signal GCLK13, a (1-2)th gate clock signal GCLK12, and a (1-1)th gate clock signal GCLK11, and become the first gate clock signal GCLK1, based on the first gate clock signal information received from the second lookup table 520. For example, the gate clock signal generator 430 may gradually change the gate clock signal from the (1-3)th gate clock signal GCLK13 to the (1-1)th gate clock signal GCLK11 through the (1-2)th gate clock signal GCLK12 based on the first gate clock signal information received from the second lookup table 520, and the gate clock signal may become the first gate clock signal GCLK1. A horizontal cycle of the (1-3)th gate clock signal GCLK13 may be longer than a horizontal cycle of the (1-2)th gate clock signal GCLK12, and the horizontal cycle of the (1-2)th gate clock signal GCLK12 may be longer than a horizontal cycle of the (1-1)th gate clock signal GCLK11. The horizontal cycle of the (1-1)th gate clock signal GCLK11 may be longer than a horizontal cycle of the first gate clock signal GCLK1.

The gate clock signal generator 430' may allow a gate clock signal to be gradually changed to the (1-3)th gate clock signal GCLK13, the (1-2)th gate clock signal GCLK12, and the (1-1)th gate clock signal GCLK11 and become the first gate clock signal GCLK1, based on the modified data enable signal DEm. For example, the gate clock signal generator 430' may gradually change the gate clock signal from the (1-3)th gate clock signal GCLK13 to the (1-1)th gate clock signal GCLK11 through the (1-2)th gate clock signal GCLK12 based on the modified data enable signal Dem, and the gate clock signal may become the first gate clock signal GCLK1.

In case that a horizontal cycle of a gate clock signal is changed in continuous frames, a change in image quality due to a change in charge time may be viewed. Therefore, in an embodiment, the horizontal cycle of the gate clock signal may be gradually changed throughout frames, thereby generating the gate clock signal. Thus, the viewing of the change in image quality due to the change in charge time may be prevented.

Hereinafter, a light emitting element in accordance with an embodiment of the disclosure is described below with reference to FIG. 11.

Figure 11:
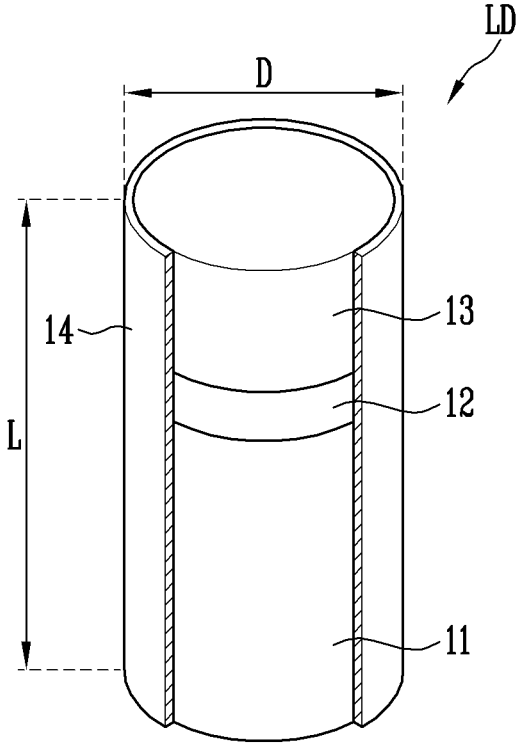
FIG. 11 is a schematic perspective view illustrating a light emitting element included in the display device in accordance with an embodiment of the disclosure.

FIG. 11 is a schematic perspective view illustrating a light emitting element included in the display device in accordance with an embodiment of the disclosure.

Referring to FIG. 11, the light emitting element LD included in the display device in accordance with the embodiment of the disclosure may include a first semiconductor layer 11, a second semiconductor layer 13, and an active layer 12 located between the first semiconductor layer 11 and the second semiconductor layer 13. In an example, the light emitting element LD may be configured as a stack structure in which the first semiconductor layer 11, the active layer 12, and the second semiconductor layer 13 are sequentially stacked in a length L direction.

The light emitting element LD may be provided in a rod shape (i.e., cylindrical shape or pillar-shape) extending in a direction (e.g., length L direction).

In case that an extending direction of the light emitting element LD is the length L direction, the light emitting element LD may have an end portion and another end portion in the length L direction. Although a pillar-shaped light emitting element LD is illustrated in FIG. 11, the kind and/or shape of the light emitting element LD in accordance with the embodiment of the disclosure is not limited thereto.

The first semiconductor layer 11 may include at least one n-type semiconductor layer. For example, the first semiconductor layer 11 may include at least one semiconductor material of InAlGaN, GaN, AlGaN, InGaN, AlN, and InN, and be an n-type semiconductor layer doped with a first conductivity type dopant such as Si, Ge or Sn. However, the material constituting the first semiconductor layer 11 is not limited thereto. The first semiconductor layer 11 may be configured with various materials.

The active layer 12 may be disposed on the second semiconductor layer 13, and may be formed in a single-quantum well structure or a multi-quantum well structure. In an embodiment, a clad layer (not shown) doped with a conductive dopant may be formed on the top and/or the bottom of the active layer 12. In an example, the clad layer may be formed as an AlGaN layer or an InAlGaN layer. In some embodiments, a material such as AlGaN or AlInGaN may be used to form the active layer 12. However, the disclosure is not limited thereto, and the active layer 12 may be configured with various materials.

In case that a voltage equal to or higher than a threshold voltage is applied to ends (e.g., both ends) of the light emitting element LD, the light emitting element LD emits light as electron-hole pairs are combined in the active layer 12. The light emission of the light emitting element LD may be controlled by using such a principle (e.g., combination of electron-hole pairs), so that the light emitting element LD may be used as a light source for various light emitting devices, including a pixel of a display device.

The second semiconductor layer 13 may be disposed on the active layer 12, and include a semiconductor layer of a type different from the type of the first semiconductor layer 11. In an example, the second semiconductor layer 13 may include at least one p-type semiconductor layer. For example, the second semiconductor layer 13 may include at least one semiconductor material of InAlGaN, GaN, AlGaN, InGaN, AlN, and InN, and include a P-type semiconductor layer doped with a second conductivity type dopant such as Mg, Zn, Ca, Sr or Ba. However, the material constituting the second semiconductor layer 13 is not limited thereto. The second semiconductor layer 13 may be formed of various materials.

In the above-described embodiment, each of the first semiconductor layer 11 and the second semiconductor layer 13 may be configured with a layer. However, the disclosure is not limited thereto. In an embodiment of the disclosure, each of the first semiconductor layer 11 and the second semiconductor layer 13 may further include at least one layer (e.g., a clad layer and/or a Tensile Strain Barrier Reducing (TSBR) layer) according to the material of the active layer 12. The TSBR layer may be a strain reducing layer disposed between semiconductor layers having different lattice structures to perform a buffering function for reducing a lattice constant difference. For example, the TSBR layer may reduce and buffer the difference between lattice constants of the first semiconductor layer 11 and the second semiconductor layer 13. The TSBR may be configured with a p-type semiconductor layer such as p-GAInP, p-AlInP or p-AlGaInP, but the disclosure is not limited thereto.

In some embodiments, the light emitting element LD may further include an insulative film 14 provided on a surface thereof. The insulative film 14 may be formed on the surface of the light emitting element LD, and surround an outer circumferential surface of the active layer 12. The insulative film 14 may further surround an area of each of the first semiconductor layer 11 and the second semiconductor layer 13. However, in some embodiments, the insulative film 14 may expose ends (e.g., both end portions) of the light emitting element LD, which have different polarities. For example, the insulative film 14 may not cover one ends (or first ends) of the first semiconductor layer 11 and the second semiconductor layer 13, which are located at ends (e.g., both ends) of the light emitting element LD in the length L direction, e.g., two bottom surfaces of a cylinder (an upper surface and a lower surface of the light emitting element LD), but may expose the one ends of the first semiconductor layer 11 and the second semiconductor layer 13.

In case that the insulative film 14 is provided on the surface of the light emitting element LD (e.g., a surface of the active layer 12), the active layer 12 may be prevented from being short-circuited with at least one electrode (not shown) (e.g., at least one contact electrode electrically connected to both ends of the light emitting element LD), etc. Accordingly, the electrical stability of the light emitting element LD may be ensured.

The light emitting element LD may include the insulative film 14 on the surface thereof, so that a surface defect of the light emitting element LD may be minimized. Thus, lifetime (or lifespan) and efficiency of the light emitting element LD may be improved. Further, in case that each light emitting element LD includes the insulative film 14, a short circuit may be prevented between light emitting elements LD, which are densely disposed. For example, although the light emitting elements LD are densely disposed, the insulative film 14 may prevent the short circuit between the adjacent ones of the light emitting elements LD.

In an embodiment, the light emitting element LD may be manufactured through a surface treatment process. For example, in case that light emitting elements LD are mixed in a liquid solution (or solvent) to be supplied to each emission area (e.g., an emission area of each pixel), each light emitting element LD may be surface-treated such that the light emitting elements LD are not unequally condensed in the solution but equally dispersed in the solution.

In an embodiment, the light emitting element LD may further include an additional component in addition to the first semiconductor layer 11, the active layer 12, the second semiconductor layer 13, and the insulative film 14. For example, the light emitting element LD may additionally include at least one phosphor layer, at least one active layer, at least one semiconductor layer, and/or at least one electrode layer, which are disposed at one ends of the first semiconductor layer 11, the active layer 12, and the second semiconductor layer 13.

The light emitting element LD may be used in various kinds of devices (e.g., display device) which require a light source. For example, at least one light emitting element LD (e.g., multiple light emitting elements LD) each having a size of nanometer scale to micrometer scale may be disposed in each pixel area of a display device, and a light source (or light source part) of each pixel may be configured by using the light emitting elements LD. However, the application field of the light emitting element LD is not limited to the display device. For example, the light emitting element LD may be used in other types of devices that require a light source, such as a lighting device.

In accordance with the disclosure, a gate signal based on (e.g., generated based on) the low grayscale gate clock signal may be supplied to a low grayscale area of the display panel, so that pixels of the normal grayscale area and pixels of the low grayscale area may have charge times equal or similar to each other. Thus, the luminance characteristic of the display panel may be improved.

The above description is an example of technical features of the disclosure, and those skilled in the art to which the disclosure pertains will be able to make various modifications and variations. Therefore, the embodiments of the disclosure described above may be implemented separately or in combination with each other.

Therefore, the embodiments disclosed in the disclosure are not intended to limit the technical spirit of the disclosure, but to describe the technical spirit of the disclosure, and the scope of the technical spirit of the disclosure is not limited by these embodiments. The protection scope of the disclosure should be interpreted by the following claims, and it should be interpreted that all technical spirits within the equivalent scope are included in the scope of the disclosure.

What is claimed is:

1. A display device comprising:

a display panel including areas including pixels electrically connected to a plurality of gate lines and a plurality of data lines;

a gate driver that supplies a gate signal to each of the plurality of gate lines;

an average grayscale calculator that receives input image data, and calculate average grayscale values with respect to the areas;

an area determiner that compares the average grayscale values with a low grayscale reference value to determine a low grayscale area among the areas, and output a charge boosting signal;

a memory that stores gate clock signal information according to a grayscale; and a gate clock signal generator that supplies a gate clock signal corresponding to the areas to the gate driver by reflecting the charge boosting signal and the gate clock signal information according to the grayscale.

2. The display device of claim 1, wherein the gate clock signal generator supplies a first gate clock signal to the gate driver, with respect to the low grayscale area among the areas, based on first gate clock signal information corresponding to the low grayscale area in the gate clock signal information according to the grayscale.

3. The display device of claim 2, wherein the gate clock signal generator supplies a second gate clock signal to the gate driver, with respect to a normal grayscale area among the areas, based on second gate clock signal information corresponding to the normal grayscale area in the gate clock signal information according to the grayscale.

4. The display device of claim 3, wherein the gate clock signal generator interpolates the first gate clock signal and the second gate clock signal to generate a third gate clock signal, and supplies the third gate clock signal to the gate driver in an interpolation area between the normal grayscale area adjacent to the low grayscale area and the low grayscale area among the areas.

5. The display device of claim 1, wherein
the areas are adjacent to each other in a first direction,
a data signal is supplied to each of the plurality of data lines disposed in each of the areas, and
the data signal is generated based on the input image data.

6. The display device of claim 1, wherein the area determiner determines, as the low grayscale area, an area having a value smaller than the low grayscale reference value among the average grayscale values.

7. The display device of claim 6, wherein the memory further stores a minimum grayscale reference value and a maximum grayscale reference value with respect to each of the areas.

8. The display device of claim 7, wherein the area determiner compares a minimum grayscale value with respect to each of the areas with the minimum grayscale reference value and compares a maximum grayscale value with respect to each of the areas with the maximum grayscale reference value to determine the low grayscale area among the areas.

9. The display device of claim 1, wherein the charge boosting signal includes grayscale information on the areas.

10. A display device comprising:
a display panel including areas including pixels electrically connected to a plurality of gate lines and a plurality of data lines;
a gate driver that supplies a gate signal to each of the plurality of gate lines; and
a timing controller that receives input image data and a data enable signal, and supplies a gate clock signal corresponding to the gate signal to the gate driver,
wherein the timing controller calculates average grayscale values with respect to the areas, compares the average grayscale values with a low grayscale reference value to determine a low grayscale area and a normal grayscale area among the areas, and supplies a gate clock signal corresponding to each of the areas to the gate driver, based on the data enable signal with respect to the area.

11. The display device of claim 10, wherein
the data enable signal includes a reference data enable signal and a modified data enable signal, and
the timing controller supplies a first gate clock signal corresponding to the low grayscale area to the gate driver, based on the modified data enable signal.

12. The display device of claim 11, wherein the timing controller supplies a second gate clock signal corresponding to the normal grayscale area to the gate driver, based on the reference data enable signal.

13. The display device of claim 12, wherein the timing controller interpolates the first gate clock signal and the second gate clock signal to generate a third gate clock signal, and supplies the third gate clock signal to the gate driver in an interpolation area between the normal grayscale area adjacent to the low grayscale area and the low grayscale area among the areas.

14. The display device of claim 10, wherein
the areas are adjacent to each other in a first direction,
a data signal is supplied to each of the plurality of data lines disposed in each of the areas, and
the data signal is generated based on the input image data.

15. The display device of claim 10, wherein the timing controller determines, as the low grayscale area, an area having a value smaller than the low grayscale reference value among the average grayscale values.

16. The display device of claim 15, further comprising:
a memory that stores a minimum grayscale reference value and a maximum grayscale reference value with respect to each of the areas,
wherein the timing controller compares a minimum grayscale value with respect to each of the areas with the minimum grayscale reference value and compares a maximum grayscale value with respect to each of the areas with the maximum grayscale reference value to determine the low grayscale area among the areas.

17. A display device comprising:
a display panel including areas including pixels electrically connected to a plurality of gate lines and a plurality of data lines;
a gate driver that supplies a gate signal to each of the plurality of gate lines;
a timing controller that supplies a gate clock signal corresponding to the gate signal to the gate driver; and
a memory that stores gate clock signal information according to a grayscale,
wherein the timing controller calculates average grayscale values with respect to the areas, compares the average grayscale values with a low grayscale reference value to determine a low grayscale area and a normal grayscale area among the areas, and supplies a gate clock signal corresponding to each of the areas to the gate driver by reflecting the gate clock signal information according to the grayscale.

18. The display device of claim 17, wherein the timing controller supplies a first gate clock signal to the gate driver, based on first gate clock signal information corresponding to the low grayscale area in the gate clock signal information according to the grayscale.

19. The display device of claim 18, wherein the timing controller supplies a second gate clock signal to the gate driver, based on second gate clock signal information corresponding to the normal grayscale area in the gate clock signal information according to the grayscale.

20. The display device of claim 19, wherein the timing controller interpolates the first gate clock signal and the second gate clock signal to generate a third gate clock signal, and supplies the third gate clock signal to the gate driver in an interpolation area between the normal grayscale area adjacent to the low grayscale area and the low grayscale area.

* * * * *